US010227992B2

(12) United States Patent
Boening et al.

(10) Patent No.: US 10,227,992 B2
(45) Date of Patent: Mar. 12, 2019

(54) ROTOR FOR A TURBOCHARGER DEVICE, TURBOCHARGER DEVICE HAVING A ROTOR, AND SHAFT FOR A ROTOR OF SAID TYPE

(71) Applicant: CONTINENTAL AUTOMOTIVE GMBH, Hannover (DE)

(72) Inventors: Ralf Boening, Reiffelbach (DE); Ralph-Maurice Koempel, Mannheim (DE)

(73) Assignee: Continental Automotive GmbH, Hannover (DE)

( * ) Notice: Subject to any disclaimer, the term of this patent is extended or adjusted under 35 U.S.C. 154(b) by 234 days.

(21) Appl. No.: 14/902,521

(22) PCT Filed: May 20, 2014

(86) PCT No.: PCT/EP2014/060290

§ 371 (c)(1),
(2) Date: Dec. 31, 2015

(87) PCT Pub. No.: WO2015/000629

PCT Pub. Date: Jan. 8, 2015

(65) Prior Publication Data

US 2016/0377089 A1 Dec. 29, 2016

(30) Foreign Application Priority Data

Jul. 3, 2013 (DE) ..... 10 2013 213 023

(51) Int. Cl.
*F04D 29/056* (2006.01)
*F04D 29/26* (2006.01)
(Continued)

(52) U.S. Cl.
CPC ..... *F04D 29/266* (2013.01); *F01D 5/025* (2013.01); *F04D 29/053* (2013.01);
(Continued)

(58) Field of Classification Search
CPC ..... F01D 25/16; F01D 25/162; F01D 25/18; F01D 25/186; F01D 5/025; F04D 29/266; F04D 29/102; F04D 29/063
See application file for complete search history.

(56) References Cited

U.S. PATENT DOCUMENTS 4,157,834 A * 6/1979 Burdette ..... F01D 11/003 277/306
4,171,137 A * 10/1979 Aizu ..... F01D 11/003 277/429
(Continued)

FOREIGN PATENT DOCUMENTS

CN 1650091 A 8/2005
CN 101040121 A 9/2007
(Continued)

*Primary Examiner* — Justin Seabe
(74) *Attorney, Agent, or Firm* — Laurence A. Greenberg; Werner H. Stemer; Ralph E. Locher

(57) ABSTRACT

A rotor for a turbocharger device has a shaft and, arranged and fixed axially one behind the other on the shaft, an impeller wheel, a sealing bushing element and an axial bearing element which rotates with the shaft. The sealing bushing element and the axial bearing element, by way of an internal thread provided on at least one of the elements, are screwed to a first external thread arranged on the shaft and are braced against a shaft shoulder. Stronger and more rigid fixing of the parts that are pushed onto the shaft, and thus also lower susceptibility to vibration-induced faults during operation, are achieved by way of this construction.

8 Claims, 9 Drawing Sheets

(51) Int. Cl.
*F01D 5/02* (2006.01)
*F04D 29/053* (2006.01)
*F04D 29/28* (2006.01)

(52) U.S. Cl.
CPC ..... *F04D 29/056* (2013.01); *F04D 29/284* (2013.01); *F05D 2220/40* (2013.01)

(56) References Cited

U.S. PATENT DOCUMENTS

| | | | | |
|---|---|---|---|---|
| 7,223,077 | B2 * | 5/2007 | Nishiyama | F04D 29/266 416/204 A |
| 7,374,402 | B2 | 5/2008 | Thiele et al. | |
| 7,909,578 | B2 | 3/2011 | Nishiyama et al. | |
| 8,641,380 | B2 | 2/2014 | McKenzie | |
| 9,206,733 | B2 * | 12/2015 | Balsley, II | F02B 37/12 |
| 9,759,093 | B2 * | 9/2017 | Donaldson | F01D 25/16 |
| 2005/0232775 | A1 | 10/2005 | Thiele et al. | |
| 2007/0214785 | A1 * | 9/2007 | Giselmo | F01D 25/16 60/598 |
| 2011/0250067 | A1 * | 10/2011 | Schlienger | F01D 11/003 415/230 |
| 2013/0004300 | A1 | 1/2013 | Scholz et al. | |

FOREIGN PATENT DOCUMENTS

| | | | |
|---|---|---|---|
| CN | 101057078 | A | 10/2007 |
| CN | 102639841 | A | 8/2012 |
| DE | 102008056058 | A1 | 2/2010 |
| DE | 102008056059 | A1 | 2/2010 |
| DE | 102009060056 | A1 | 6/2011 |
| EP | 1803941 | A1 | 7/2007 |
| WO | 2011087662 | A2 | 7/2011 |

* cited by examiner

ROTOR FOR A TURBOCHARGER DEVICE, TURBOCHARGER DEVICE HAVING A ROTOR, AND SHAFT FOR A ROTOR OF SAID TYPE

BACKGROUND OF THE INVENTION

Field of the Invention

The invention lies in the field of mechanics, specifically mechanical engineering, and can be used to particular advantage in turbocharger devices.

In the case of internal combustion engines in the form of piston engines, turbocharger devices are used to assist the induction of air by the pistons by way of an imparted positive pressure of the inflowing air. For this purpose, a turbocharger normally has a turbine which, in the exhaust-gas flow, is driven by hot air and is fixedly mounted on a common shaft with a compressor wheel, which in turn, in the air supply duct of the internal combustion engine, effects an increase in pressure of the inflowing air. The shaft which connects the turbine to the compressor wheel must transmit considerable torques at very high rotational speeds (several 10,000-100,000 revolutions per minute). Challenges encountered in the mechanical design process are, inter alia, the stability with respect to high temperatures that prevail in the exhaust-gas flow, and the bearing arrangement of the shaft for very high rotational speeds. Also associated with these are additional problems in the configuration of the oil lubrication of the bearings, which are commonly in the form of plain bearings, sometimes with floating bearing bushings. Accordingly, bearing elements for the radial bearing arrangement and the axial bearing arrangement, and seal elements for sealing off the oil chamber in the housing of the turbocharger device, must be arranged in reliable and stable fashion on the shaft.

In this context, one known design is based on an axial bearing element, a seal bushing element and a compressor wheel (impeller) being pushed on axially one behind the other from a first end of the shaft and then being fixedly braced together in an axial direction, by means of a central threaded nut which is screwed onto an external thread of the shaft, such that, even under the mechanical loads encountered during operation, there is no risk of loosening of the individual parts with respect to the shaft, and said individual parts rotate together with the shaft.

An additional measure for ensuring the coherence of said arrangements may in this case consist in a certain elasticity, and/or an elastic element, being provided in order to compensate any settling behavior of the parts. For this purpose, it would for example be possible for the shank of the shaft to be formed as an "expansion bolt".

BRIEF SUMMARY OF THE INVENTION

Against the background of the prior art, it is the object of the present invention to provide a rotor for a turbocharger device, in the case of which rotor permanent and reliable coherence of the individual parts is ensured in a technically simple and inexpensive manner.

The object is achieved, with regard to a rotor for a turbocharger device, by way of the features of the invention as claimed. The dependent claims represent advantageous refinements of the invention. Furthermore, the invention realizes a turbocharger device having a rotor according to the invention, and a shaft for a rotor of said type, as claimed.

Specifically, the invention relates to a rotor for a turbocharger device, having a shaft and having, arranged and fixed axially one behind the other on the shaft, an impeller, a seal bushing element and an axial bearing element which rotates with the shaft, wherein the seal bushing element and the rotating axial bearing element are, by way of an internal thread which is provided on at least one of said elements, screwed together with a first external thread arranged on the shaft and are braced against a shaft shoulder.

By means of a threaded screw connection to the shaft, said threaded screw connection being associated with the sealing bushing element and/or with the axial bearing element that rotates with the shaft, at least one of said parts is firmly connected and fixed to the shaft, and if appropriate, the other part is fixedly clamped between the screwed part and a shaft shoulder. The impeller, which may typically be in the form of a compressor wheel, may additionally be fixed to the shaft at the first end thereof by way of a dedicated fixing, for example a further screw connection. In this way, it is possible for the individual parts to be fixed to the shaft more firmly and more reliably and, even in the event of loosening of a single part, for the coherence of the other parts to be ensured. The elastic forces that can be generated here are higher than those in the case of all of the individual parts being fixed by way of a single screw connection at the shaft end. In this way, firstly, the reliability of the coherence is increased, and secondly, the transmission of a greater torque is made possible, as the parts mounted onto the shaft additionally increase, by way of their coherence, the total torque that can be transmitted via the rotor.

For this purpose, it may advantageously be provided that the seal bushing element has an internal thread which is screwed together with a first external thread of the shaft, and that the axial bearing element which rotates with the shaft is arranged axially between the seal bushing element and the shaft shoulder.

In this case, the axial bearing element, which for example substantially has a ring-shaped axial bearing disk, can be freely displaceable on the shaft. In this case, the axial bearing element is fixed axially on the shaft exclusively by way of the interference fit on the shaft in a radial direction and by way of the clamping action of the seal bushing element.

It may advantageously also additionally or alternatively be provided that the axial bearing element has an internal thread which is screwed together with an external thread of the shaft.

In this case, the axial bearing element is independently additionally screwed onto an external thread of the shaft and pressed against a shaft shoulder.

In this way, the axial pressing pressure owing to the individual screw connections of seal bushing element and axial bearing element can be added.

It may furthermore advantageously be provided that the axial bearing element, or an axial sub-section of the axial bearing element, is formed integrally with the seal bushing element.

In this case, the number of individual parts pushed onto the shaft can be reduced, and the coherence thereof can be further improved. In this way, the torque transmissible by the rotor is increased, and the overall rigidity of the rotor is increased. The additionally transmissible torque is then determined firstly by the friction between the impeller and the seal bushing element and secondly by the friction between the axial bearing element and the shaft shoulder.

In particular, owing to the increase in rotor stiffness owing to stable coherence of the pushed-on parts, the vibration characteristic of the rotor and of the shaft is consequently also improved, which is highly advantageous at the high rotational speeds of a turbocharger during operation and also during the expected changes in rotational speeds corresponding to different load states of the engine. The loosening of individual parts of the rotor as a result of vibrations is likewise made less likely in this way.

A further advantageous refinement of the invention provides that the impeller is braced axially with respect to the seal bushing element, the axial bearing element and in particular the shaft shoulder by way of a central screw-connection element which is screwed on axially from the end of the shaft, in particular by way of a threaded nut which is screwed onto a second external thread of the shaft.

Owing to the screw connection of the impeller against the seal bushing element and, if appropriate, the axial bearing element with an axial pressing force, aside from the fixing of the impeller, static friction is generated which can also serve for the additional transmission of torques via said parts which have been pushed onto the shaft in addition to the torque transmitted by the shaft body itself. Furthermore, owing to the axial pressing-together of the pushed-on parts, the stiffness of the rotor is increased beyond the stiffness of the shaft body. A conventional unilateral screw-connection element is a threaded nut screwed onto the outside of the shaft shank, though it is also conceivable for an internal thread to be formed into a blind bore of the shaft, into which internal thread there can be screwed a terminating body which extends outward beyond the diameter of the shaft, engages around the shaft there, and exerts an axial force on the impeller.

During the mounting of the various threaded parts onto the shaft, it is expedient for said parts to be firmly screwed on one after the other, starting with the axial bearing element, which is commonly arranged closest to the shaft shoulder, followed by the seal bushing element and finally the impeller.

The invention may also advantageously be refined such that the second external thread of the shaft and the first external thread of the shaft have counter directional thread gradients.

In this case, it is ensured that a torque imparted to the impeller—which torque may for example consist in the air resistance during operation, which opposes a rotation of the impeller—rotates the impeller relative to the shaft, and furthermore, a situation is prevented in which the element adjacent to the impeller, that is to say typically the seal bushing element, is jointly rotated in the same direction owing to the static friction forces.

This yields additional stabilization of the rotor coherence with respect to undesired relative rotations that could result in undesired loosening of the individual parts.

It may furthermore also advantageously be provided that the second external thread of the shaft and the first external thread of the shaft have co directional thread gradients with different thread gradient angles, wherein the first external thread is of steeper form than the second external thread.

In the case of such an embodiment of the external thread, it is likewise the case that, if one of the parts is rotated, the co-rotation of the static friction partner, that is to say for example in the case of primary rotation of the impeller, prevents the co-rotation of the seal bushing element, as the different thread gradients of the threads would cause the parts to be pressed against one another more intensely, which is prevented by the pressing pressure that is produced already at the outset during the assembly process.

The invention also relates to a rotor as already described above, and to a turbocharger device having a rotor of said type and having a housing, wherein, on the housing, in accordance with the invention, there is arranged an axial bearing disk which is fixed with respect to the housing and which is of ring segment-shaped form, is open to one side for installation purposes, and is extended through by the shaft.

Since it is normally the case that the shaft is connected to the housing after said shaft has been pre-assembled as a whole, that is to say also provided with the pushed-on parts, such as the axial bearing element that rotates with the shaft, a seal bushing element and an impeller, the rotor must normally be pushed into the housing from one side, transversely with respect to the longitudinal direction of the shaft. Thus, the shaft cannot be pushed through ring-shaped bearing elements fixed with respect to the housing, and must either be already pre-assembled with all ring-shaped bearing elements, or must be pushed from the side into bearing elements fixed with respect to the housing. This is possible, with regard to an axial bearing disk, in that the axial bearing disk fixed with respect to the housing does not constitute a complete ring, but constitutes only a ring segment with an opening, into which the shaft, with the axial bearing element that rotates with the shaft, can be pushed. A further part of the axial bearing disk fixed with respect to the housing may be added and screwed on, in order to complete the axial bearing, after the installation of the shaft.

In addition to a rotor of the above-mentioned type and a turbocharger device, the present invention also relates to a shaft for a rotor of the above-described type, in the case of which the shaft has a first external thread between a first shaft end and a shaft shoulder at which the shaft diameter abruptly increases as viewed from the first shaft end, and in the case of which the shaft has, in addition to the first external thread, a further thread, in particular a second external thread, which is spatially separate from the first external thread.

The provision of two separate threads, or in other words two spatially mutually separate axial sections each equipped with a thread, permits the separate fixing of and axial exertion of pressure on or bracing of an impeller, on the one hand, and a seal bushing element that has been pushed onto the shaft, and/or an axial bearing element that rotates with the shaft, on the other hand. In this way, a loosening of some of said parts with respect to the shaft is prevented more reliably than if all of the parts were pressed against one another and against a shaft shoulder by way of a single screw connection. Altogether, it is also possible for higher axial forces to be imparted than in the case of a single screw connection.

Below, the invention will be shown in the figures, and discussed below, on the basis of an exemplary embodiment.

DESCRIPTION OF THE INVENTION

Figure 1:
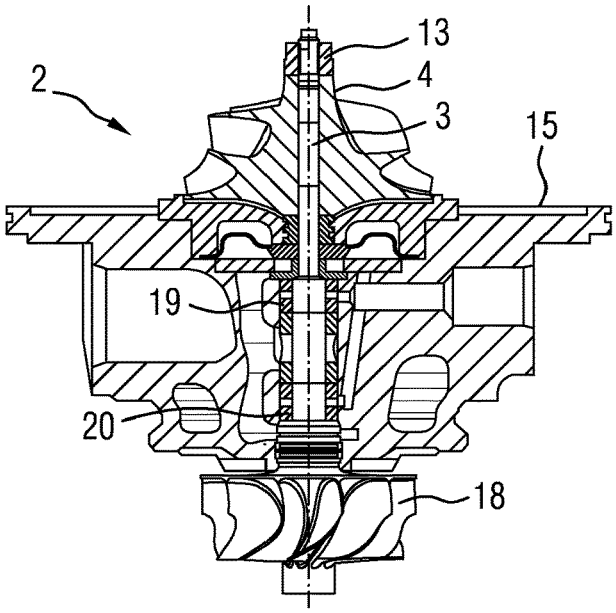
FIG. 1 shows a longitudinal section through a rotor of a turbocharger device according to the prior art, with a part of a housing.

FIG. 1 shows a part of a turbocharger device 2 as per the prior art in a longitudinal section through the shaft of the rotor, with a partial view of housing parts. The rotor has, on the exhaust-gas side, a turbine wheel 18 which is driven by the exhaust-gas flow of an internal combustion piston engine. The turbine wheel 18 is mounted on a common shaft 3 with an impeller/compressor wheel 4 which, in an air supply duct, delivers air to the intake valves of the internal combustion engine and compresses it with the aim of achieving more effective combustion in the piston chambers.

The compressor wheel 4 is fastened to the shaft 3 by means of a threaded nut 13 which, as a central screw-connection element, is screwed onto an end-side external thread of the shaft 3 and presses the compressor wheel 4, with the interposition of various additional elements, against a shaft shoulder.

Furthermore, in the interior of the housing 15 of the turbocharger device 2, there are provided two radial bearings 19, 20 which serve for radial mounting of the shaft 3, even at the rotational speeds that typically amount to several ten thousand revolutions per minute to a few hundred thousand revolutions per minute. The radial bearings are for example in the form of floating plain bearings, in the case of which the floating bearing bushings can rotate, at approximately half of the rotational speed of the shaft, relative to bearing elements that are fixed with respect to the housing.

Lubricating oil is supplied both to the radial bearings and to an axial bearing, which will be discussed in more detail further below, by way of an oil feed device 21.

Figure 2:
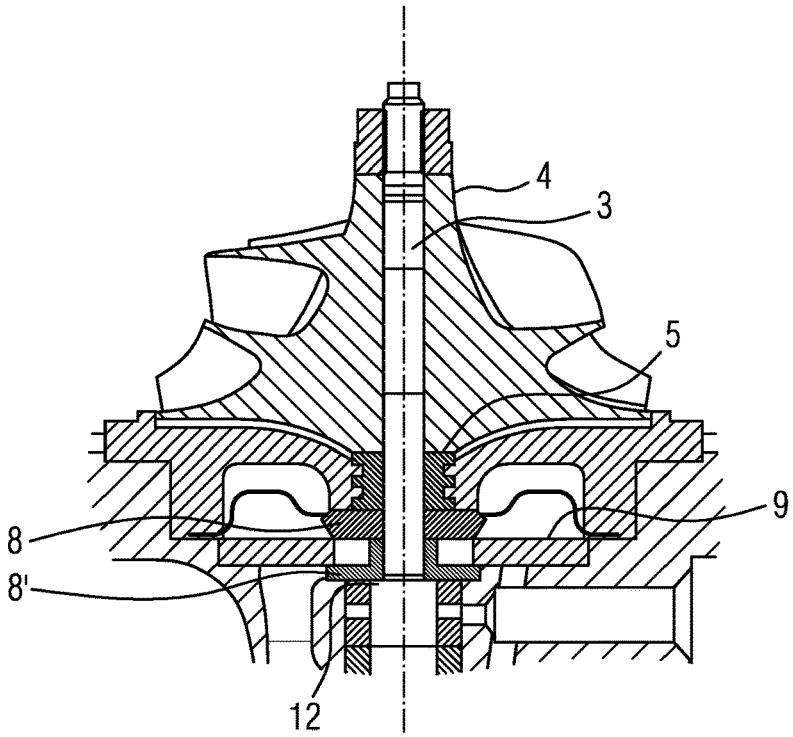
FIG. 2 shows an enlarged detail from FIG. 1.

FIG. 2 shows a detail from FIG. 1 on an enlarged scale, wherein in particular, in addition to the compressor wheel 4, the ring-shaped components clamped between the latter and a shaft shoulder 12 are illustrated, of which a first constitutes a seal bushing element 5, a second constitutes a first part 8 of an axial bearing element that rotates with the shaft, and a third constitutes a second part 8' of an axial bearing element that rotates with the shaft. The three stated clamped elements 5, 8, 8' are freely displaceable in the axial direction on the shaft 3, and are held between the compressor wheel 4 and the shaft shoulder 12 exclusively by static friction forces.

FIG. 2 furthermore illustrates an axial bearing disk 9 which is fixed with respect to the housing and which projects radially in between the first part 8 and the second part 8' of the rotating axial bearing element and is arranged axially between these. The axial bearing disk 9 which is fixed with respect to the housing thus forms a substantially ring-shaped or ring segment-shaped disk on which the two parts 8, 8' of the axial bearing element, which rotates with the shaft, slide and are guided.

Figure 3:
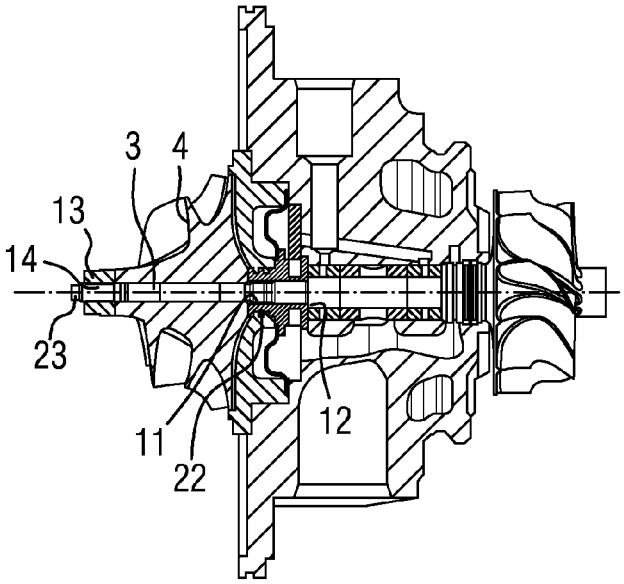
FIG. 3 shows a longitudinal section through a rotor of a turbocharger device according to the invention, with a part of housing.

FIG. 3 shows, in the context of the invention, a construction in which a combination bushing 22, which combines a seal bushing element and a first and a second part of an axial bearing element, which rotates with the shaft, in unipartite fashion, is screwed onto a shaft 3' which bears a first external thread 11. Here, only that axial section which corresponds with the seal bushing element is equipped with an internal thread, which is screwed onto the corresponding first external thread 11 of the shaft. The first and second part of the axial bearing element are not equipped with an internal thread, and are pushed with an accurate fit onto that axial section of the shaft which is situated adjacent to the first external thread 11.

The combination bushing 22 is firmly braced against a shaft shoulder 12 of the shaft 3' by way of the screw connection.

Furthermore, proceeding from the first end 23 of the shaft 3', a compressor wheel 4 is pushed onto the shaft 3' and pressed with respect to the combination bushing 22 by way of a threaded nut 13. The threaded nut 13 is, for this purpose, screwed onto a second external thread 14 on the first end 23 of the shaft 3'. For this purpose, the threaded nut 13 has a matching outer contour, for example a hexagonal contour.

It is however advantageously possible for the combination bushing 22, at at least one of its elements, that is to say for example at the axial section that corresponds with the seal bushing element, to have an octagonal or square contour on one of the parts that correspond with the axial bearing element that rotates with the shaft, which contour permits the engagement of a tool, for example a wrench, for imparting the screwing action.

Figure 4:
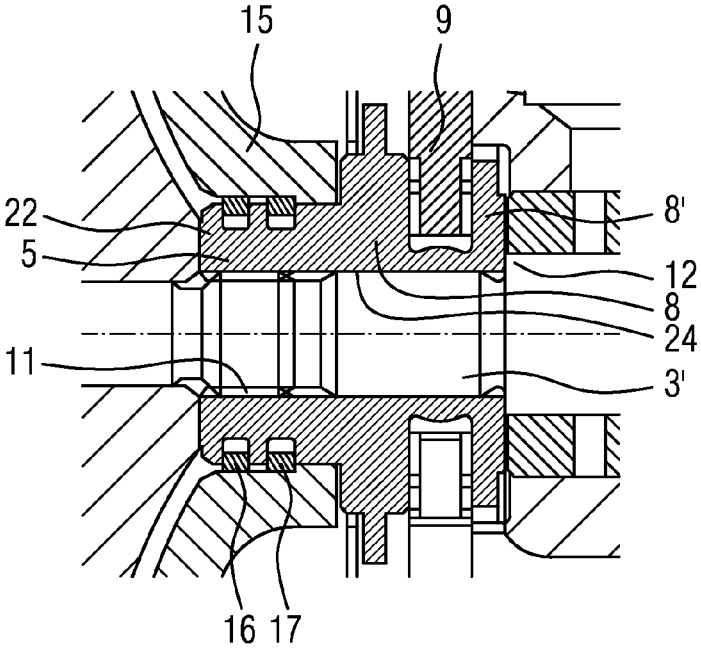
FIG. 4 shows an enlarged detail from FIG. 3, FIGS. 5 to 8 show different views of a combination bushing which combines a seal bushing element and an axial bearing element that rotates with the shaft.

A detail of the construction that is shown in an overview in FIG. 3 is shown more specifically in FIG. 4. The combination bushing 22 is illustrated on an enlarged scale, said combination bushing having a first axial section 5, which corresponds with a seal bushing element, a second section, which corresponds with the first part 8 of a rotating axial bearing element, and a third section, which corresponds to the second part 8' of an axial bearing element that rotates with the shaft. The individual sections are delimited with respect to one another by dashed lines in FIG. 4. It can also be seen from FIG. 4 that the second and third axial sections of the combination bushing 22, formed by the first part 8 and the second part 8' of the axial bearing element, are not equipped with an internal thread, but rather are equipped with a cylindrical inner surface 24 which can be pushed axially over the first external thread 11 of the shaft 3'. For this purpose, the first external thread 11, after the cutting of the thread, is stripped, that is to say subjected to cutting machining, such that the outer contour of the external thread 11 corresponds as accurately as possible to the outer contour of the shaft 3' in the region of the cylindrical inner surface 24 of the elements 8, 8'. Thus, it is possible to realize an accurate fit between the thread-free part of the combination bushing 22 and the shaft, and thus a centering and fixing action, which is conducive to eliminating imbalances of the rotor.

FIG. 4 also shows a part of the axial bearing disk 9, which is fixed with respect to the housing, and piston rings 16, 17 on the first axial section of the combination bushing 22, which first axial section corresponds with the seal bushing element 5. Thus, the seal bushing element, together with encircling outer grooves and piston rings 16, 17 guided therein, forms an effective seal of the shaft with respect to the housing 15.

Figure 5:
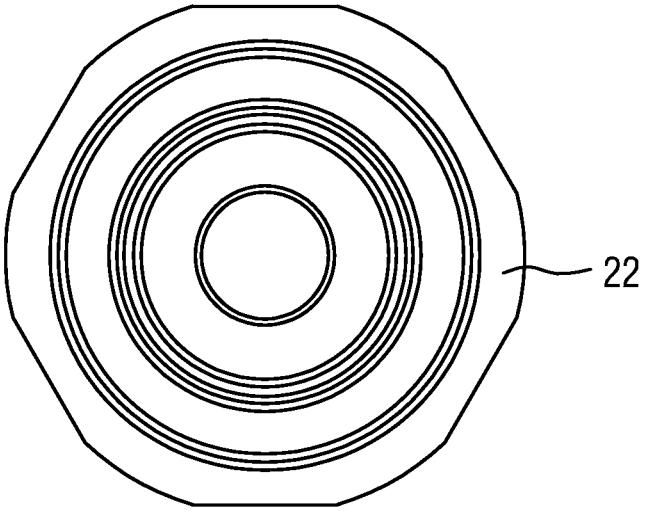
Figure 6:
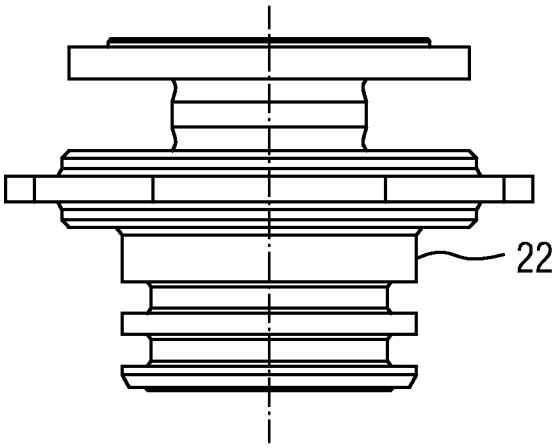
Figure 7:
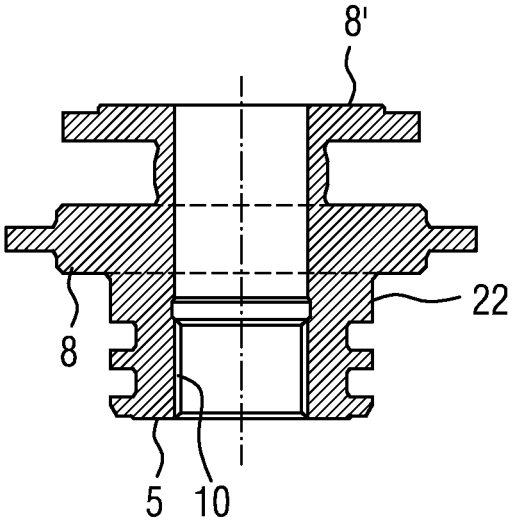
Figure 8:
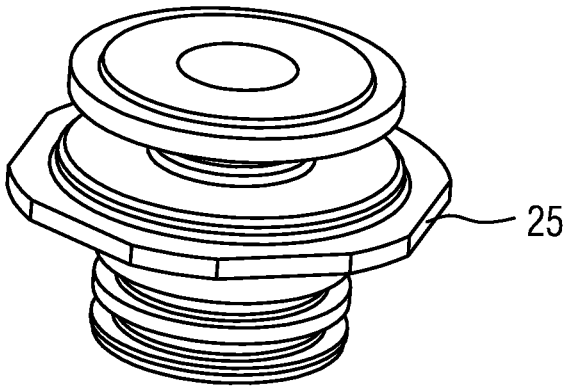

FIGS. 5, 6, 7 and 8 show the combination bushing 22 in various views, specifically in a front view in FIG. 5, in a side view in FIG. 6, in a longitudinal section in FIG. 7, and in a three-dimensional view in FIG. 8. In FIG. 7 in particular, it is possible to see the axial sections of the combination bushing 22 corresponding to the seal bushing element 5, the first part 8 of the axial bearing element and the second part 8' of the axial bearing element. It can also be seen that only the seal bushing element 5 has an internal thread 10.

The illustration also shows that a polygonal outer contour 25 of the combination bushing 22 is provided in the region of the first part 8 of the axial bearing element.

Figure 9:
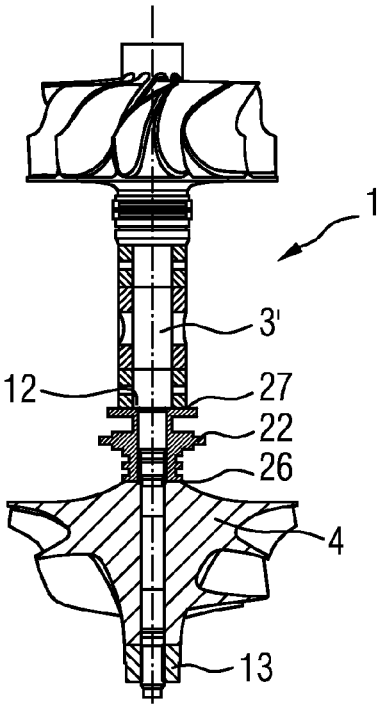
FIG. 9 is an illustration of a rotor, partially in a side view and partially in longitudinal section, with a compressor wheel and with a combination bushing pushed onto the shaft.

FIG. 9 illustrates a side view and a partially longitudinally sectional view of a rotor 1 as has basically already been shown in FIGS. 3 and 4. From FIG. 9, it can be seen particularly clearly that the contact surface 26 at which the compressor wheel 4 bears against the combination bushing 22 is larger than the contact surface, in the contact region 27, between the combination bushing 22 and the shaft shoulder 12. It is clear that a considerable torque can thus be transmitted in the region between the combination bushing 22 and the compressor wheel 4. This is advantageous in particular when the torque to be transmitted is not limited by the contact surface 27 between the combination bushing 22 and the shaft shoulder 12, because the combination bushing 22 itself has an independent fixing to the shaft 3'. The advantages of the invention are realized, in part, in this way.

Figure 10:
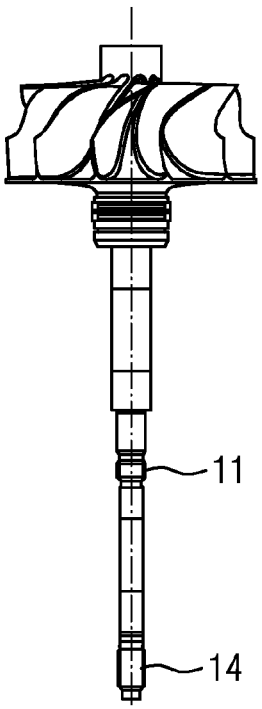
FIG. 10 shows the illustration from FIG. 9, wherein the compressor wheel and the combination bushing have been omitted.

FIG. 10 shows the rotor from FIG. 9 without the pushed-on combination bushing, the compressor wheel and the fastening nut 13, but with the first external thread 11, which is clearly spaced apart axially from the second external thread 14.

Figure 11:
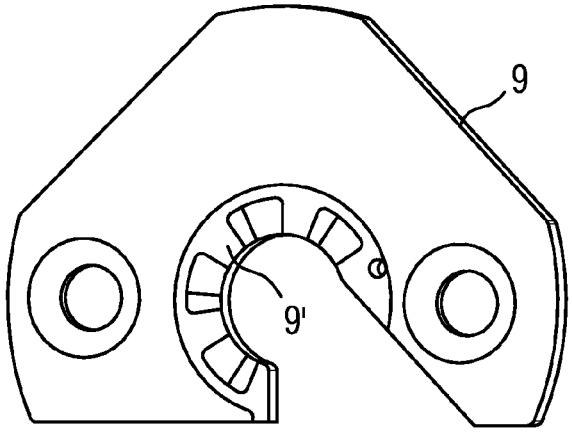
FIG. 11 is an illustration of an axial bearing disk fixed with respect to the housing.
Figure 12:
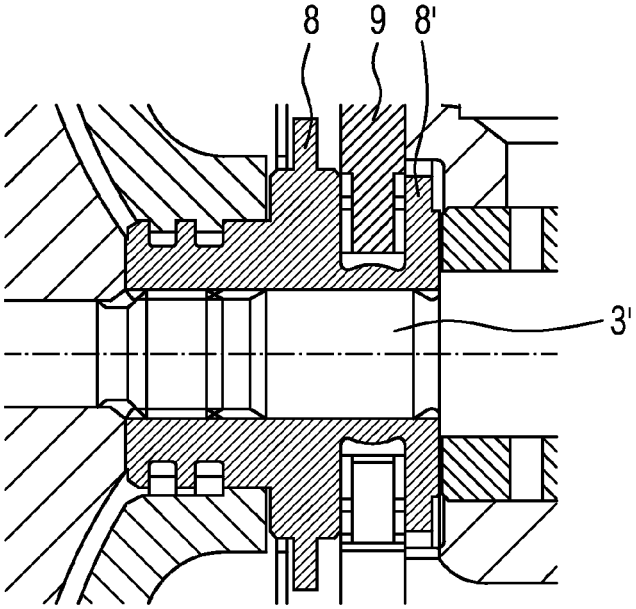
FIG. 12 is a detail illustration of a shaft with a combination bushing screwed onto it.
Figure 13:
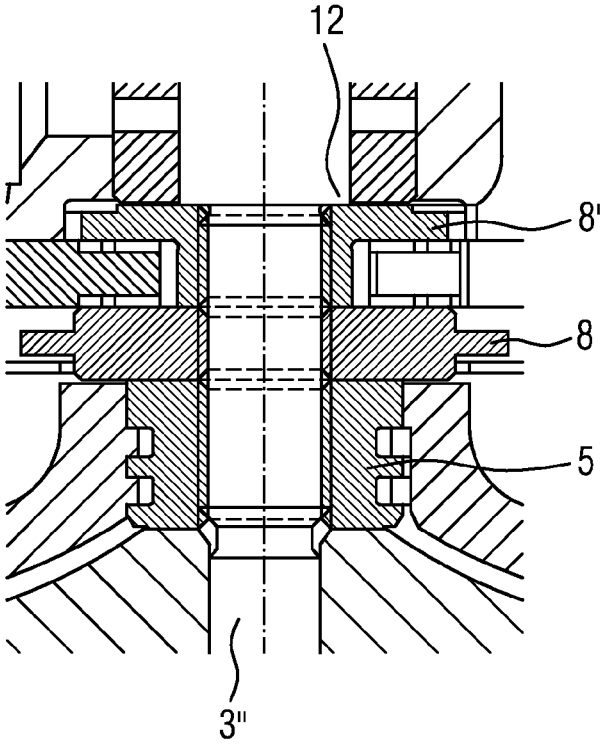
FIG. 13 is a detail illustration of a shaft with parts of the axial bearing element that rotates with the shaft having been pushed onto said shaft, and of a screwed-on seal bushing element.

FIG. 11 shows, in a three-dimensional view, an axial bearing disk 9 which is fixed with respect to the housing and which has a ring segment-shaped bearing surface 9'. The latter is interrupted over an angle range of approximately 60° in order that the axial bearing disk which is fixed with respect to the housing is left open at that side and in order to make it possible for the shaft, and the axial bearing element that rotates with the shaft, to be pushed in from the side. As the shaft is pushed in, the first and second parts 8, 8' of the axial bearing element that rotates with the shaft are positioned on both sides of the axial bearing disk 9 that is fixed with respect to the housing, as can be seen in FIG. 12.

FIGS. 13, 14, 15 and 16 show, in each case in different details and views, a configuration of a turbocharger device in which the seal bushing element 5, the first part 8 of an axial bearing element that rotates with the shaft, and the second part 8' of the axial bearing element are in the form of three separate components each with a central internal thread 10, 10', 10". Correspondingly, there is provided on the shaft 3" a first external thread 11 which is formed so as to be of such an axial length that all three elements 5, 8, 8' can be screwed onto it opposite the shaft shoulder 12. In this way, an axial pressure can be built up by means of each individual one of the elements 5, 8, 8', such that the individual parts are very well secured against loosening. In this context, it is expedient for each of the components 5, 8, 8' to be equipped with a circumferential outer contour which permits the engagement of a tool, for example of a wrench, in order that each of the elements can be individually tightened on the thread 11. The thread 11 extends almost as far as the shaft shoulder 12, wherein an axial spacing remains provided between the end of the external thread 11 and the shaft shoulder 12. The shaft 3" has at least three axial sections with different diameters, wherein the region with the greatest diameter forms the shaft shoulder 12, a region with relatively small outer diameter bears the external thread 11, and, relative to that axial section of the shaft which is equipped with the external thread 11, an axial region facing toward the first shaft end 23 is of further reduced diameter, such that the elements 5, 8, 8' can be easily pushed onto the shaft over the first shaft end 23 as far as the external thread 11.

In the end-side region of the shaft 3", said shaft has the second external thread 14 for the screwing-on of a threaded nut and for the fastening of a compressor wheel between the threaded nut 13 and the seal bushing element 5.

Figure 14:
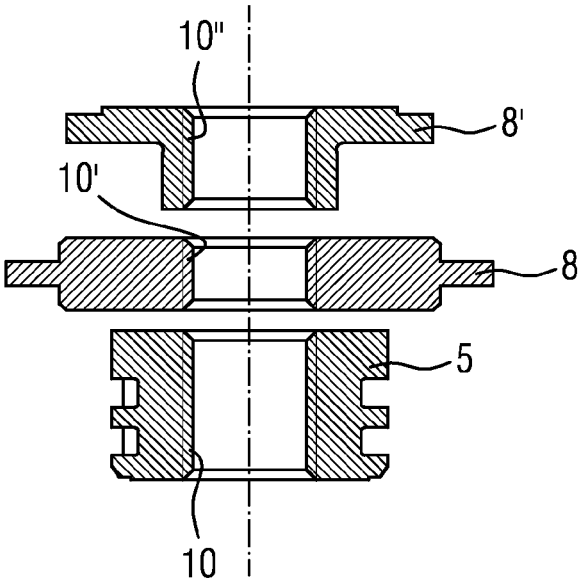
FIG. 14 shows, in detail, two parts of an axial bearing element that rotates with the shaft, and a seal bushing element, in longitudinal section.
Figure 15:
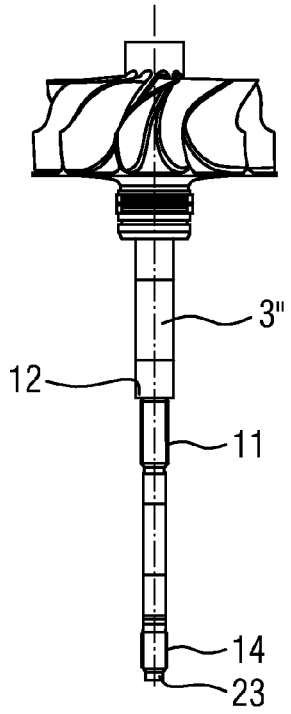
FIG. 15 shows, in a side view, a rotor which fits together with parts illustrated in FIG. 14, with a partially unpopulated shaft.
Figure 16:
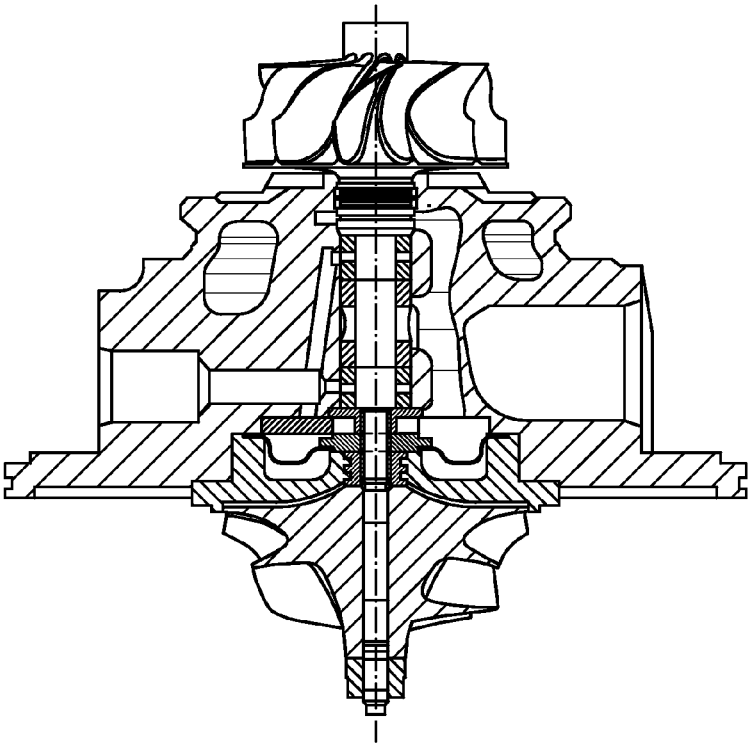
FIG. 16 shows a rotor populated with the parts illustrated in FIG. 14 and with a compressor wheel.

FIG. 16 shows the assembled rotor in a partially longitudinally sectional image, whereas FIG. 14 illustrates the three elements 5 (seal bushing element), 8 (first part of the axial bearing element that rotates with the shaft) and 8' (second part of the axial bearing element that rotates with the shaft) in longitudinal sections one above the other.

Figure 17:
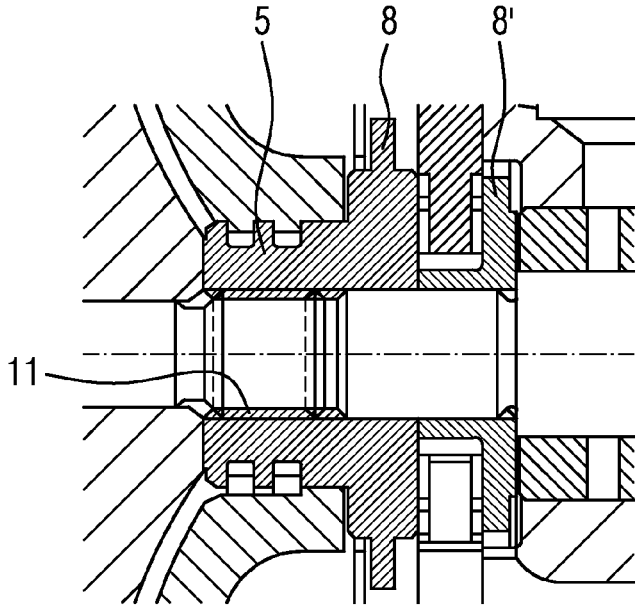
FIG. 17 is a detail illustration of a combination bushing on a shaft in longitudinal section.
Figure 18:
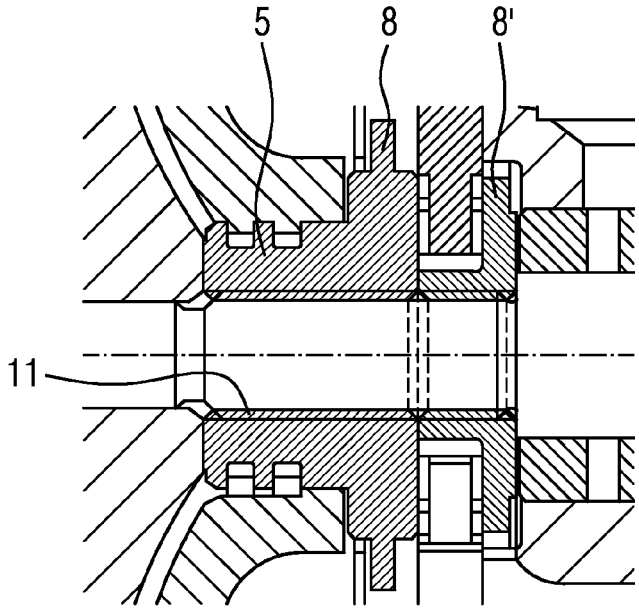
FIG. 18 is a further detail illustration of another embodiment of a combination bushing on a shaft in longitudinal section.

FIGS. 17 and 18 each show a construction in which the first part 8 of the axial bearing element that rotates with the shaft is integrally combined with the seal bushing element 5. In both of the constructions illustrated, the so-called bearing collar, that is to say the second part 8' of the axial bearing element, has been separated from the first part 8 of the axial bearing element and is formed as an independent body. This permits simplified installation of the axial bearing through the possibility of the shaft being equipped with the second part of the axial bearing element and subsequently being passed through a positionally fixed axial bearing disk. It is thus possible, if appropriate, for the axial bearing disk that is fixed with respect to the housing to be in the form of a two-part, fully encircling bearing element. In this context, the use of an axial bearing disk that is open at the side is however also conceivable.

The combination bushing, which has been combined to form one part and which combines the parts 5 (seal bushing element) and 8 (first part of the axial bearing element) can be separately screwed onto the external thread 11' of the shaft.

The described embodiments of the invention permit particularly firm coherence of the various parts that have been pushed onto a shaft, such as the parts of the axial bearing element that rotates with the shaft, a seal bushing, and a compressor wheel. Furthermore, owing to a particular firm connection of the parts mounted onto the shaft, the flexural stiffness of the rotor is increased, and thus the susceptibility of the shaft to vibrations, and the susceptibility to the formation of imbalances, are reduced. Ultimately, by means of the described arrangements, it is possible for particularly high torques to be transmitted between a turbine wheel and a compressor wheel.

The invention claimed is:

1. A rotor for a turbocharger device, the rotor comprising:

a shaft, said shaft being formed with an end, a first external thread, a second external thread, and a shaft shoulder;

an impeller, a seal bushing element, and an axial bearing element, which rotates with said shaft, arranged and fixed axially one behind another on said shaft, said seal bushing element being separate from said axial bearing element;

said seal bushing element formed with an internal thread meshing with said first external thread on said shaft and bracing said seal bushing element and said axial bearing element against said shaft shoulder; and a threaded nut screwed onto said second external thread of said shaft axially from said end of said shaft;

said axial bearing element including two parts radially extending away from said shaft and axially displaced away from each other to form a receiving groove with opposing parallel sides therebetween;

said threaded nut axially bracing said impeller with respect to said seal bushing element, said axial bearing element, and said shaft shoulder; and said axial bearing element being part of a bearing.

2. The rotor according to claim 1, wherein said axial bearing element is arranged axially between said seal bushing element and said shaft shoulder.

3. The rotor according to claim 2, wherein said axial bearing element has an internal thread meshing with said first external thread of said shaft.

4. The rotor according to claim 1, wherein said second external thread of said shaft and said first external thread of said shaft have counter-directional thread gradients.

5. The rotor according to claim 1, wherein said second external thread of said shaft and said first external thread of said shaft have co-directional thread gradients with different thread gradient angles, wherein said first external thread is steeper than said second external thread.

6. The rotor according to claim 1, wherein said first external thread of said shaft is machined with an outer diameter that is smaller than or equal to an outer diameter of said shaft between said first external thread and said shaft shoulder.

7. The rotor according to claim 1, wherein said seal bushing element is formed with said internal thread, and said axial bearing element is entirely axially displaced away from said internal thread.

8. A turbocharger device, comprising:

a rotor according to claim 1;

a housing;

an axial bearing disk disposed on and fixed with respect to said housing, said axial bearing disk having a ring segment-shaped form and being open to one side for installation purposes;

said shaft extending through said axial bearing disk; and said axial bearing disk radially extending between said two parts of said axial bearing element and into said receiving groove in order to guide said two parts of said axial bearing element.

* * * * *